US005189270A

United States Patent [19]

Matumoto et al.

[11] Patent Number: 5,189,270

[45] Date of Patent: Feb. 23, 1993

[54] CONTACT STRUCTURE FOR VACUUM CIRCUIT BREAKER

[75] Inventors: Morihisa Matumoto, Kitaibaraki; Kouji Suzuki, Takahagi; Shunkichi Endo; Yukio Kurosawa, both of Hitachi, all of Japan

[73] Assignee: Hitachi, Ltd., Tokyo, Japan

[21] Appl. No.: 735,889

[22] Filed: Jul. 25, 1991

[30] Foreign Application Priority Data

Aug. 3, 1990 [JP] Japan ..... 2-205014

[51] Int. Cl.[5] ..... H01H 33/66

[52] U.S. Cl. ..... 200/144 B

[58] Field of Search ..... 200/144 B

[56] References Cited

U.S. PATENT DOCUMENTS 4,267,415 5/1981 Holmes et al. ..... 200/144 B

FOREIGN PATENT DOCUMENTS 60-3721 5/1985 Japan .

*Primary Examiner*—Harold Broome

*Attorney, Agent, or Firm*—Antonelli, Terry Stout & Kraus

[57] ABSTRACT

A contact structure for a vacuum circuit breaker has an electrically insulating vacuum vessel, fixed and movable contact units sealed in the vacuum vessel and shield members surrounding the fixed and movable contact units in the vacuum vessel. Particles of a metal are applied to at least a part of the inner surface of the vacuum vessel.

6 Claims, 6 Drawing Sheets

CONTACT STRUCTURE FOR VACUUM CIRCUIT BREAKER

BACKGROUND OF THE INVENTION

The present invention relates to a contact structure for a vacuum circuit breaker used for temporarily interrupting power supplying when an abnormality occurs in power substations, factories and other buildings.

As shown in FIG. 1, a conventional contact structure for a vacuum circuit breaker comprises two electrically insulating cylindrical members 1*a*-1, 1*a*-2 which are axially disposed and end plates 2 and 3, provided at outer ends of the cylindrical members 1*a*-1 and 1*a*-2, respectively, for forming an evacuated vacuum vessel 1. A fixed contact 4 is connected with a first end portion of an electrically conductive rod 4*a* having a second end portion which passes through the end plate 2 in an airtight manner. A movable contact 5 is connected with a first end portion of an electrically conductive rod 5*a* having a second end portion which is movably and hermetically sealed to the end plate 3 through bellows 6. The fixed contact 4 and the conductive rod 4*a* form a fixed contact unit while the movable contact 5 and the conductive rod 5*a* form a movable contact unit.

A first end shield member 7-1 is provided for the fixed contact 4. A central shield member 8 is provided in the center of the vacuum vessel 1. A second end shield member 7-2 is provided for the movable contact 5. In other words, the central shield member 8 surrounds the first end portions of the conductive rods 4*a* and 5*a* and the contacts 4 and 5. The first end shield member 7-1 surrounds the second end portion of the conductive rod 4*a*. The second end shield member 7-2 surrounds the second end portion of the conductive rod 5*a*. These shield members 7-1 and 7-2 play an important role to prevent the vapor of a metal generated between the contacts 4 and 5 on current interruption from being deposited upon the inner wall of the vacuum vessel 1. However, the breakdown voltage is lowered since the electrically insulating cylindrical members 1*a*-1, 1*a*-2 are disposed in the vicinity of the end shield members 7-1, 7-2 and the central shield member 8. This is due to a fact that a secondary electron avalanche takes place on the inner surfaces of the insulating cylindrical embers 1*a*-1 and 1*a*-2 when a high voltage is applied to the contact structure. A countermeasure against this has been proposed that wherein the insulating cylindrical members 1*a*-1 and 1*a*-2 are coated on the inner side thereof with a material having a secondary electron emission efficiency $\delta$ not greater than 1 such as chromium oxide ($Cr_2O_3$). For example, refer to JP-A-60-93721 (laid-open May 25, 1985). A method has been proposed in which the insulating cylindrical members 1*a*-1 and 1*a*-2 are coated with films of chromium oxide 1*b*-1 and 1*b*-2, respectively only on the inner side thereof facing a gap between the central shield member 8 and the end shield members 7-1 and 7-2. The coating film is 0.1 $\mu$m to 5 $\mu$m in thickness and the coating is performed by vacuum deposition or sputtering. This enables the electric charges on the inner side of the insulating cylindrical members 1*a*-1 and 1*a*-2 to be neutralized for increasing the breakdown voltage and the period of time required for the coating process to be shortened and can provide a contact structure for a vacuum circuit breaker which is economical and has a high blocking voltage and a high capacity.

The resistivity of chromium oxide at room temperatures is in the order of $10^3$ $\Omega$cm. If the insulating cylindrical member is coated with chromium oxide on the inner side facing the gap between the central shield member 8 and the end shield members 7-1 and 7-2 to form a coating layer having a thickness of 0.1 $\mu$m to 5 $\mu$m, the electric resistance of the coating layer is generally not higher than 10M$\Omega$. The electrons emitted from the central shield member 8 and the end shield members 7-1 and 7-2, in particular from the end thereof will impinge upon the surface of the chromium oxide layers 1*b*-1 and 1*b*-2 to elevate the temperature on the surface thereof. Chromium oxide has negative temperature characteristics in which the resistivity is lowered with an increase of the temperature. The surface temperature of the layers 1*b*-1 and 1*b*-2 will be elevated due to collision with electrons when the contact structure is in operation with a voltage applied thereto, and the electric resistance of the chromium layer will be further lowered. If an overvoltage is applied to the contact structure of the vacuum circuit breaker which is kept in operation with a voltage applied thereto for a long period of time, no flashover occurs at an initial stage, but a flashover may occur between the central shield member 8 and the end shield members 7-1 and 7-2 via the chromium oxide layers 1*b*-1 and 1*b*-2.

Meanwhile, if coating with chromium oxide is achieved by vacuum deposition or sputtering, a large amount of impurities will be generated inside of an evaporation apparatus or a sputtering apparatus, so that the life time of the apparatus may be shortened. The melting point of chromium oxide is as high as 2320° C. A relatively long period of time is required to perform a coating by vacuum deposition or sputtering. Coating with chromium oxide thus has various problems.

SUMMARY OF THE INVENTION

It is an object of the present invention to provide a contact structure for a vacuum circuit breaker having an enhanced anti-creepage.

According to one aspect of the present invention, a contact structure for a vacuum circuit breaker has an electrically insulating vacuum vessel, fixed and movable contact units sealed in the vacuum vessel and shield members surrounding the fixed and movable contact units in the vacuum vessel, in which particles of a metal are applied to at least a part of the inner surface of the vacuum vessel.

According to another aspect of the present invention, the vacuum vessel has first and second insulating cylindrical members made of an electrically insulating material and are coupled to each other at their first ends and first and second end plates engage with second ends of the first and second insulating cylindrical members which are not coupled to each other. Each of the cylindrical members having an inner surface, and fixed and movable contact units are sealed in the vacuum vessel. Each of the contact units having a conductive rod and a contact provided at a first end portion of the rod, with second end portions of the conductive rods of the fixed and movable contact units respectively protruding through the first and second end plates. A central shield member is provided to surround the first end portions and the contacts of the fixed and movable contact units in the vacuum vessel a first end shield member is provided to surround the second end portion of the fixed contact unit in the vacuum vessel. A second end shield member is provided to surround the second end portion of the movable contact unit in the vacuum vessel, and particles of a metal are applied to at least a part of the inner surface of each of the first and second cylindrical members of the vacuum vessel.

According to another aspect of the present invention, it is preferable that the diameter of the particles of a metal are not substantially larger than 10 μm and that the between the applied particles or the particle group and the adjacent particles or the particle group be substantially 10 to 100 μm.

The metal particles may be formed of copper, oxygen-free copper, aluminum, iron or a stainless steel.

The electrons emitted from the central shield member 8 and the end shield members 7-1 and 7-2 will collide with the surface of the insulating cylindrical members 1a-1 and 1a-2 to emit secondary electrons. The insulating cylindrical members are made of glass or $Al_2O_3$ ceramics and have a secondary electron emission efficiency which is not less than 1 for a wide range of the primary electron energy as represented by curves I and II in FIG. 2. Therefore, the insulating cylindrical members are positively electrically charged on the inner surface thereof. The positive electric charges are accumulated on the metal particles spread and applied onto the inner surface of the insulating cylindrical members. Some of the electrons emitted from the central shield member 8 and the end shield member 7 will directly collide with the metal particles on the inner surface of the insulating cylindrical members. The secondary electron emission efficiency of a metal is generally represented by curve III in FIG. 2. It is found from this curve that the secondary electron emission efficiency is slightly higher than 1 in a range of several hundred eV of the primary electron energy. The primary electron energy is so high in the high voltage vacuum circuit breaker that the metal particles could be regarded as being negatively charged for the whole energy range of such primary electrons. Therefore, negative charges on the metal particles will be neutralized by positive charges accumulated by the insulating cylindrical members, with a result that the inner surfaces of the insulating cylindrical members over which the metal particles are spread and applied are effectively immune to charging or electrification. Electric charging or electrification of the insulating cylindrical members which may cause an electron avalanche can be prevented to enhance the breakdown voltage of the contact structure of the vacuum circuit breaker.

Furthermore, spreading application of the metal particles to the inner surfaces of the insulating cylindrical members provides a high insulating resistance between the particles so there is no reduction in the insulating resistance of the insulating cylindrical members.

DESCRIPTION OF THE PREFERRED EMBODIMENTS

Figure 1:
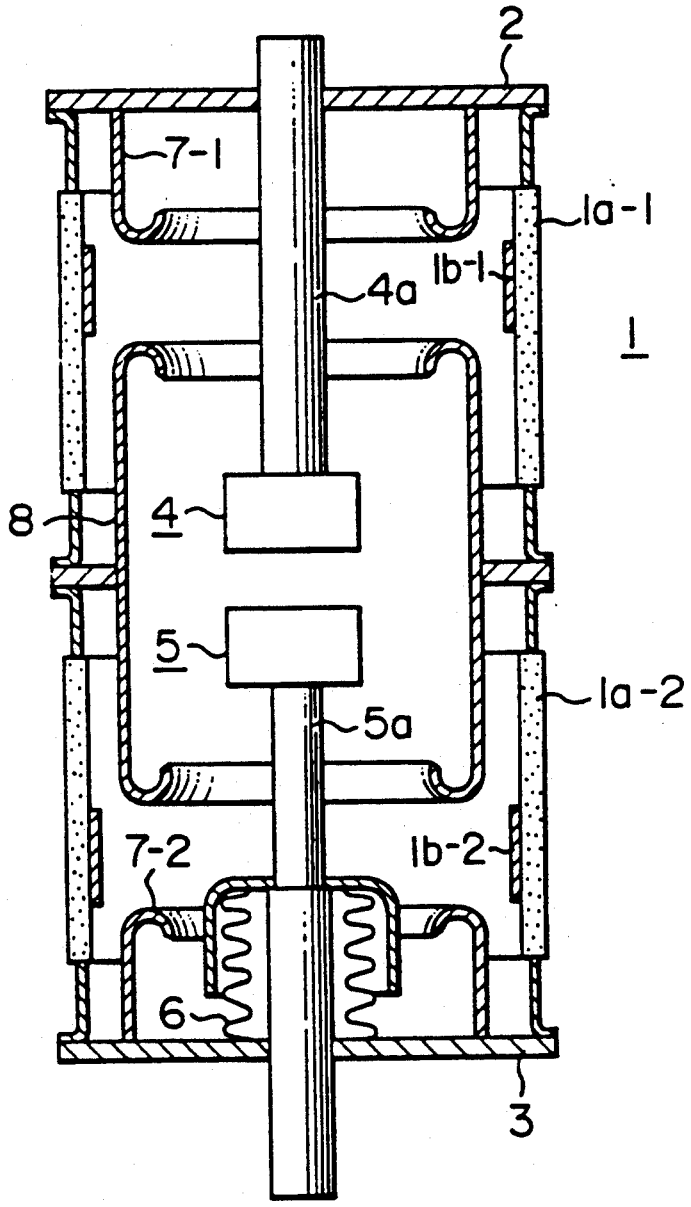
FIG. 1 (PRIOR ART)
FIG. 1 is a sectional view showing a prior art contact structure of a vacuum circuit breaker.
Figure 3:
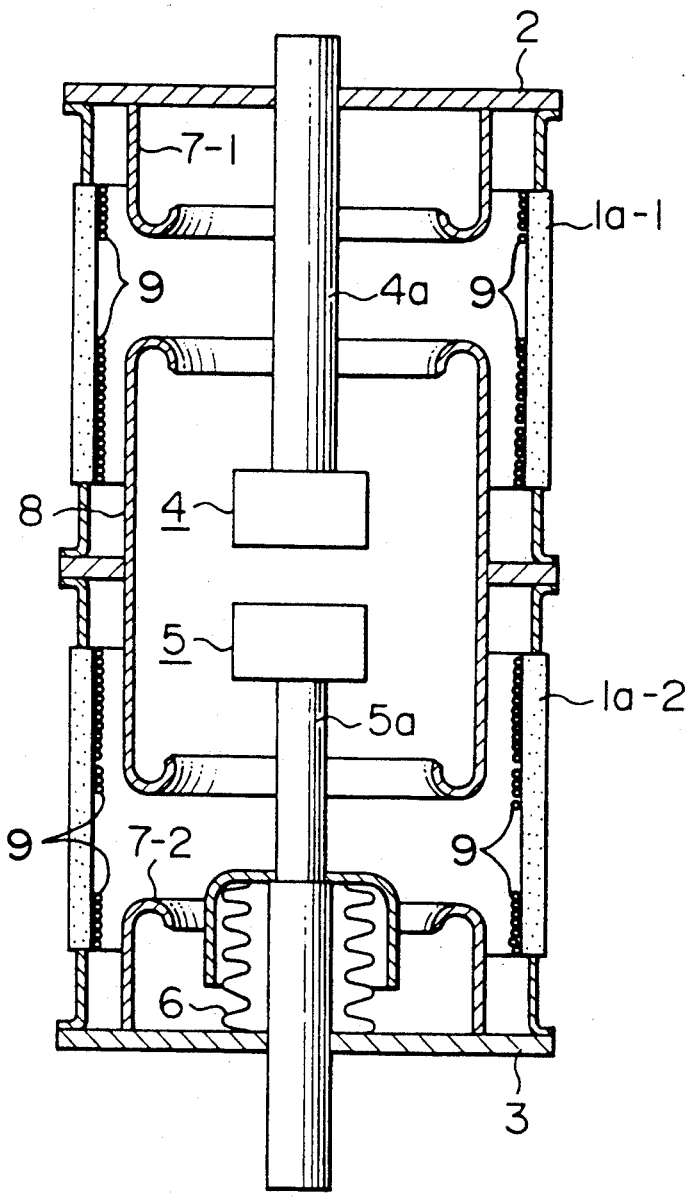
FIG. 3 is a sectional view of a contact structure of a vacuum circuit breaker according to an embodiment of the present invention.

Referring now to the drawings wherein like reference numerals are used throughout the various views to designate like parts and, more particularly, to FIG. 3, wherein the arrangement of the components may be identical to that of FIG. 1, although not restricted thereto, according to the present invention, a central shield member 8 and first and second end shield members 7-1 and 7-2 are cylindrical in shape has both ends inwardly projecting and the end of each of the first and second shield members 7-1 and 7-2 which face said central shield member 8 is inwardly projecting. Particles of a metal are applied to at least a part of the inner surfaces of the insulating cylindrical members 1a-1 and 1a-2. Preferably, the particles 9 of a metal are spread over and applied to at least those portions of the inner surfaces of the first and second insulating cylindrical members 1a-1 and 1a-2 which face the inwardly projecting ends of the central shield member 8 and face ends of the first and second end shield members opposed to the central shield member 8.

Figure 2:
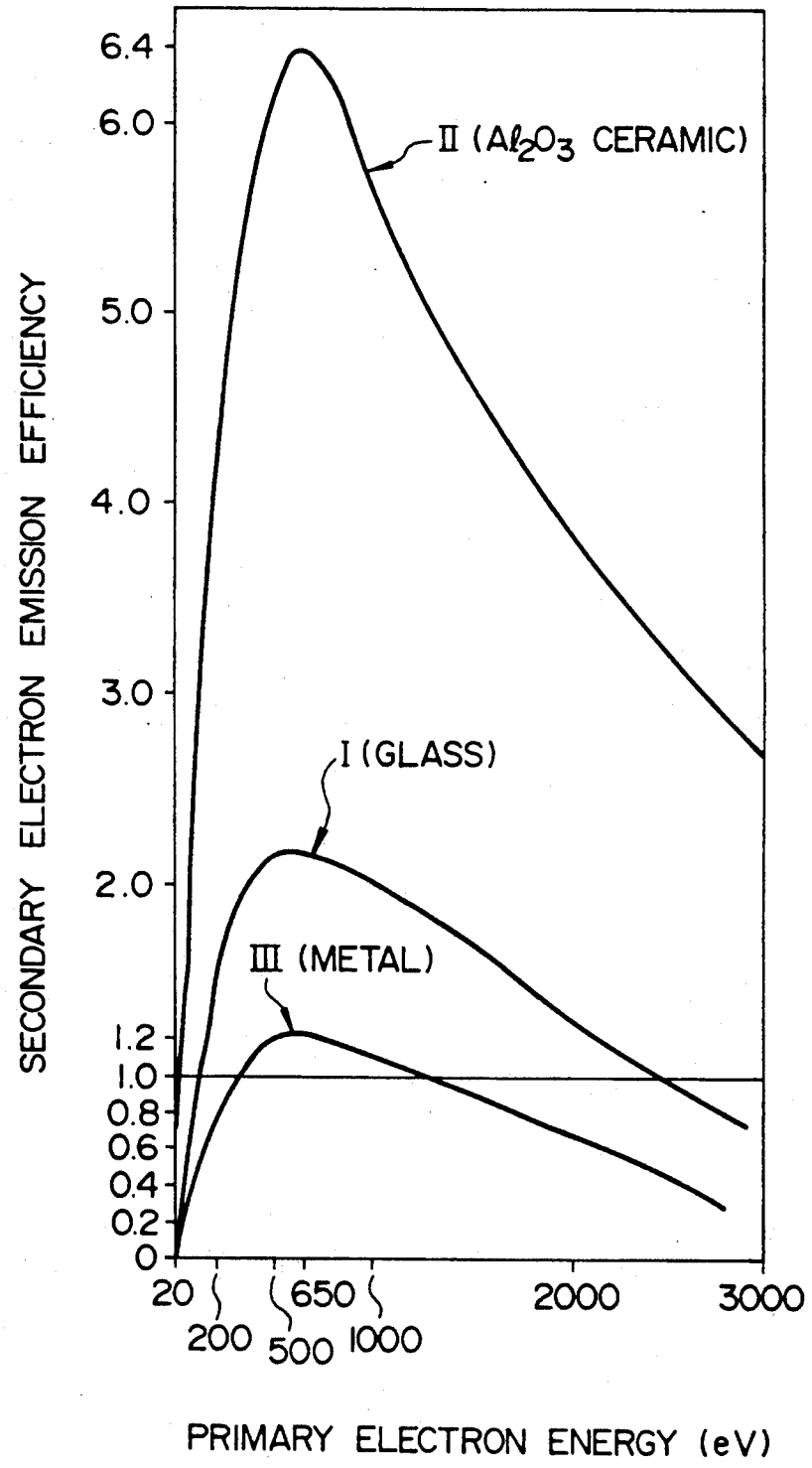
FIG. 2 is a graph showing secondary electron emission characteristics of $Al_2O_3$ ceramics, glass and metal.
Figure 4:
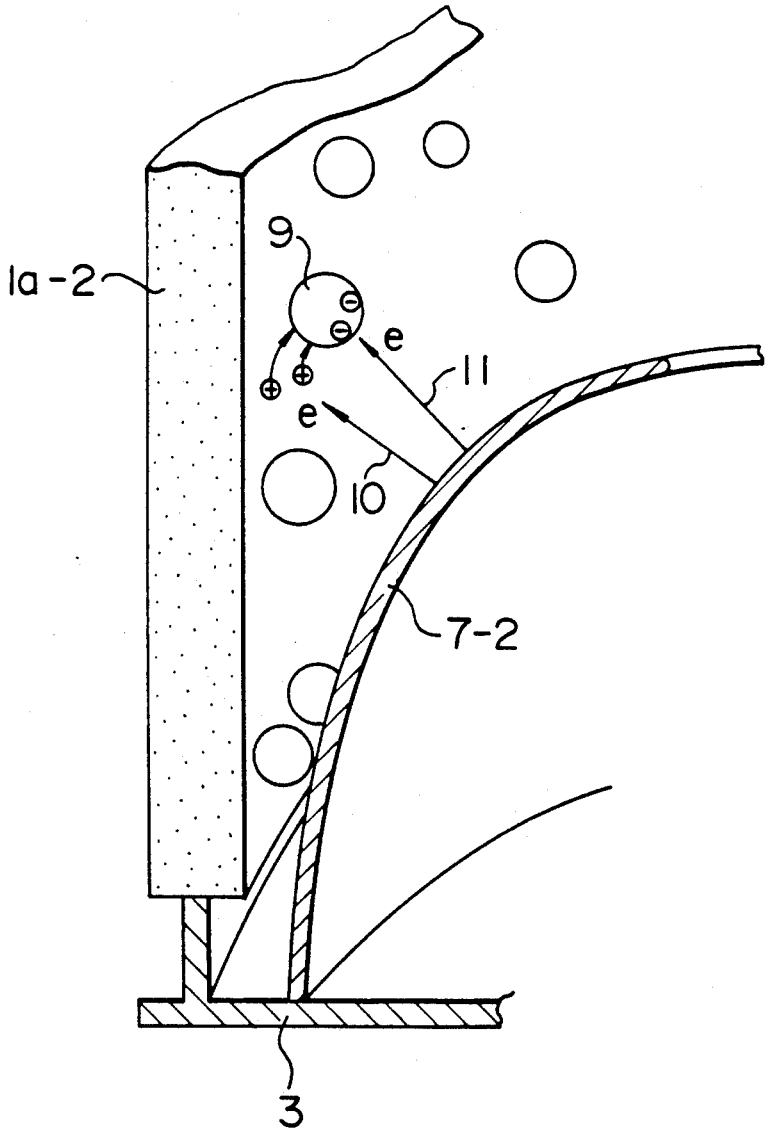
FIG. 4 is a partial, cut away and perspective enlarged view showing the contact structure shown in FIG. 3.

FIG. 4 is an enlarged view showing a portion of the second end shield member 7-2 and the components therearound. Some of the electrons 10 emitted from the end shield member 7-2 (relatively more electrons are emitted from, in particular, the end of the shield member 7-2) will directly collide with the insulating cylindrical member 1a-2 to emit secondary electrons therefrom with a result that positive electric charges are accumulated on the inner surface of the insulating cylindrical member 1a-2. The positive electric charges are then accumulated on the particles 9 of a metal existing near the positive electric charges. Other of the electrons emitted from the end shield member 7-2 will directly collide with the metal particles 9 so that the particles 9 are negatively charged due to secondary electron emission effect (refer to curve III in FIG. 2). The electric charges on the metal particles 9 are neutralized with both the positive electric charges generated in the cylindrical member 1a-2 by the electrons 10 and accumulated on the metal particles 9 and the negative electric charges directly generated on the metal particles 9 so that the surface of the insulating cylindrical member 1a-2 is apparently little charged. Since the metal particles 9 are spread over and applied to the inner surface of the cylindrical member 1a-2, the metal particles or metal particle groups are electrically isolated from each other and will not lower the anti-creepage resistance of the insulating cylindrical member 1a-2. It has been found that the diameter of the metal particles 9 of 0.5 μm to 10 μm and the distance between particles or particle group and adjacent particles or particle groups of 10 μm to 100 μm are most effective from the viewpoint of assuring the anti-creepage resistance of the cylindrical member 1a-2 and preventing charging of the cylindrical member.

Deposition or application of the particles 9 of a metal can be achieved by, for example, sputtering. When the particles are applied to the inner surface of the cylindrical member 1a-2 by sputtering, the applied particles will grow and a part of the grown particles will form particle groups. It is preferable that the resistance of the cylindrical member be substantially not less than $10^{11}$ Ω so that the particles or particle groups on the inner surface of the cylindrical member 1a-2 will not form an electrically conductive layer as a whole. To this end, the above-mentioned particles 9 should preferably meet the above-mentioned particle diameter and the distance between the particles/particle groups and the adjacent particles/particle groups. The above-mentioned particle size and the distance is possible by a sputtering technique known to those skilled in the art.

Figure 5:
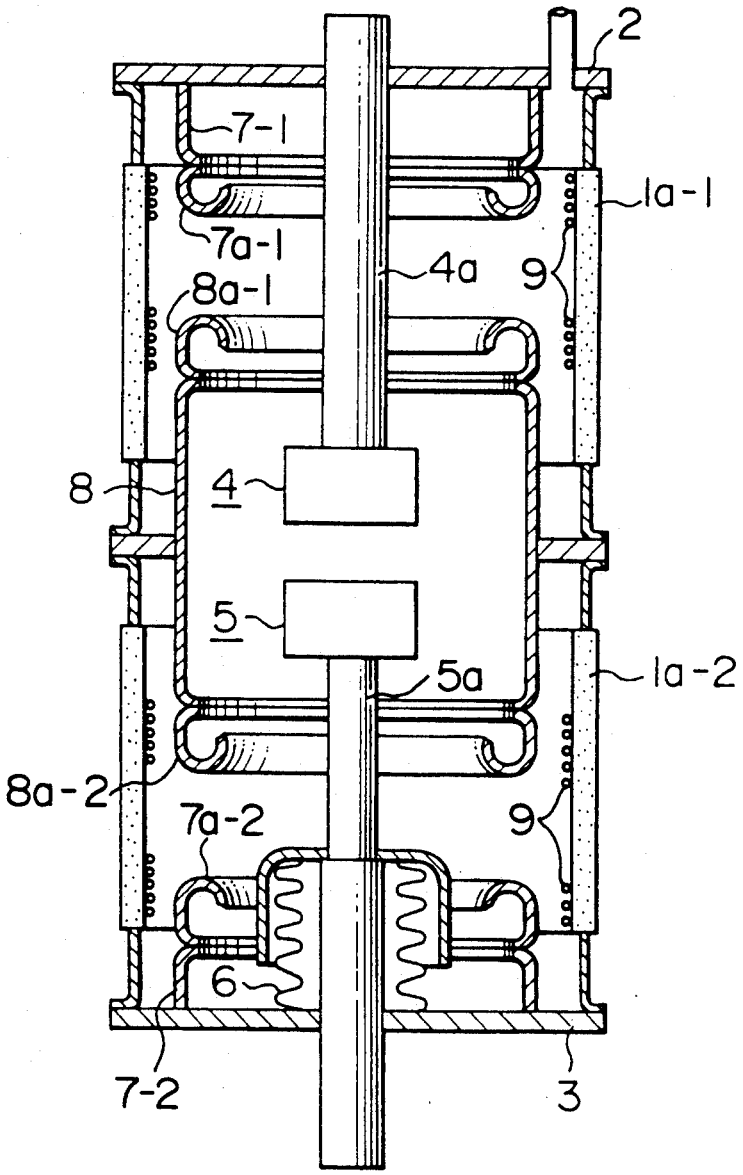
FIG. 5 is a sectional view showing another embodiment of a contact structure of a vacuum circuit breaker according to another embodiment of the present invention.

Sputtering for application of the metal particles to the inner surface of the insulating cylindrical member(s) 1a-1 and/or 1a-2 may be performed for each of the insulating cylindrical members. Alternately, sputtering may be performed by radio frequency glow discharging after the contact structure has been assembled as shown in FIG. 5. FIG. 5 shows a contact structure of a vacuum circuit breaker in which the end portions 7a-1, 7a-2, 8a-1 and 8a-2 of the end and central shield members 7-1, 7-2 and 8 are made of copper so that copper can be sputtered thereto. Particles of copper are radio-frequency glow discharged so that they can be mainly applied to the surfaces of the insulating cylindrical members 1a-1 and 1a-2 in the vicinity of the end portion of each shield member, which are subject to a high electric field.

Figure 6:
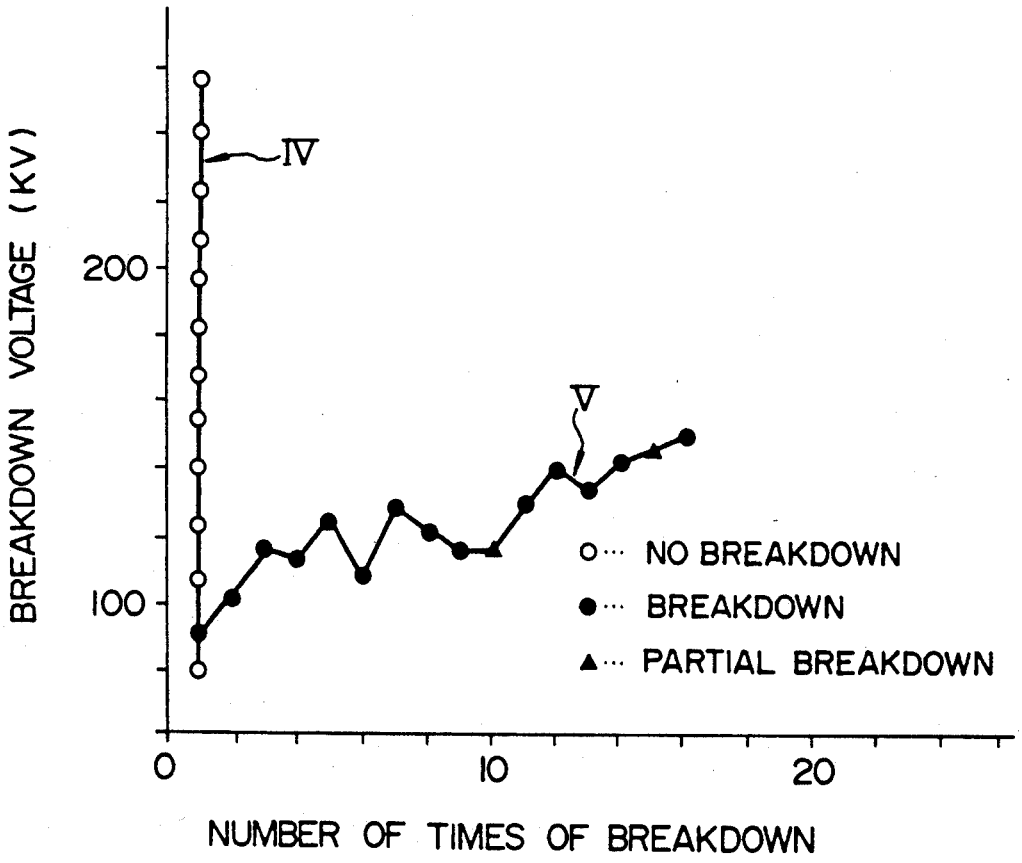
FIG. 6 is a graph of breakdown characteristics showing an effect of the present invention.

FIG. 6 shows direct current discharge characteristics of a vacuum vessel including a ceramic cylindrical member to which copper particles are applied by sputtering in accordance with an embodiment of the present invention and of a prior art vacuum vessel including a ceramic cylindrical member to which no metal particles are applied. Curve IV represents characteristics of the vacuum vessel according to the present invention while curve V represents the characteristics of the prior art vacuum vessel. The particle diameter and particle-to-particle spacing for the copper particles applied to the cylindrical member were about 5 μm and about 10 μm, respectively. A predetermined particle diameter and a predetermined average particle-to-particle spacing may be obtained by adjusting vacuum pressure and sputtering time with the sputtering apparatus used.

It is seen from FIG. 6 that curve IV shows that no electric discharge occurs when 255 KV is applied between the contacts while curve V shows that an electric discharge firstly occurs at 90 KV and the discharging voltage will only increases up to 150 KV even after electric discharges has occurred 16 times.

In accordance with the described embodiments of the present invention, the anti-creepage resistance can be enhanced since the insulating cylindrical members can be prevented from being electrically charged.

The anti-creepage resistance of the insulating cylindrical members is not reduced since the particles of a metal are spread thereover and applied to the cylindrical members.

Particularly, if the particles are made of oxygen-free copper, no gas emission is caused during sputtering, which will not lower the evacuation of the vacuum vessel. The dielectric breakdown strength of the contact structure can be thus enhanced.

Since it will suffice to spread and apply metal particles to the insulating cylindrical members, the period of time for sputtering is less than a time for the formation of the electrically conductive layer. Therefore, a contact structure of a vacuum circuit breaker which is inexpensive and has a high breakdown voltage can be provided.

We claim:

1. A contact structure for a vacuum circuit breaker, comprising:

a vacuum vessel of an electrically insulating material having an inner surface;

fixed and movable contact units sealed in said vacuum vessel;

shield means surrounding said fixed and movable contact units in said vacuum vessel; and particles of a metal applied to at least a part of the inner surface of said vacuum vessel, wherein said particles have a diameter substantially in a range of 0.5 μm to 10 μm, and are distributed as one of individual particles or groups of particles so distributed so as to be spaced from an adjacent particle or adjacent particle groups by a distance substantially in a range of from 10 μm to 100 μm.

2. A contact structure according to claim 1, wherein said metal is copper.

3. A contact structure according to claim 1, wherein said metal is oxygen-free copper.

4. A contact structure according to claim 1, wherein said metal is aluminum, chromium, iron or a stainless steel.

5. A contact structure for a vacuum circuit breaker, comprising:

a vacuum vessel having first and second insulating cylindrical members made of an electrically insulating material and coupled to each other at their first ends and first and second end plates engaged with second ends of said first and second insulating cylindrical members which are not coupled to each other, each of said cylindrical members having an inner surface;

fixed and movable contact units sealed in said vacuum vessel, each of said contact units having a conductive rod and a contact provided at a first end portion of the rod, second end portions of the conductive rods of the fixed and movable contact units protruding through the first and second end plates, respectively;

a central shield member surrounding said first end portions of the conductive rods and said contacts of said fixed and movable contact units in said vacuum vessel;

a first end shield member surrounding said second end portion of the conductive rod of said fixed contact unit in said vacuum vessel;

a second end shield member surrounding said second end portion of the conductive rod of said movable contact unit in said vacuum vessel; and particles of a metal applied to at least a part of the inner surface of each of said first and second cylindrical members of said vacuum vessel, wherein said particles have a diameter substantially in a range of 0.5 μm to 10 μm, and are distributed as one of individual particles or groups of particles so distributed so as to be spaced from an adjacent particle or adjacent particle groups by a distance substantially in a range of 10 μm to 100 μm.

6. A contact structure according to claim 5, wherein each of said central shield member, said first end shield member and said second shield member is cylindrical and has an inner surface, said central shield member has both ends thereof inwardly projecting, an end of each of said first and second end shield members faces said central shield member and is inwardly projecting, said first insulating cylindrical member surrounds at least the inwardly projecting ends of said first end shield member and of said central shield member, said second insulating cylindrical member surrounds the inwardly projecting ends of said second end shield member and of said central shield member, and said particles of a metal are applied to at least those portions of the inner surfaces of said first and second insulating cylindrical members which are relatively near said inwardly projecting ends of said central shield member and said first and second end shield members.

* * * * *